US009429875B1

(12) United States Patent
Suenami

(10) Patent No.: US 9,429,875 B1
(45) Date of Patent: Aug. 30, 2016

(54) DEVELOPING DEVICE AND IMAGE FORMING APPARATUS HAVING THE SAME

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/019,552

(22) Filed: Feb. 9, 2016

(30) Foreign Application Priority Data

Mar. 10, 2015 (JP) ..... 2015-046798

(51) Int. Cl.
*G03G 15/08* (2006.01)

(52) U.S. Cl.
CPC ..... *G03G 15/0889* (2013.01); *G03G 15/0844* (2013.01); *G03G 15/0893* (2013.01)

(58) Field of Classification Search
CPC ..... G03G 15/0844; G03G 15/0889; G03G 15/0891; G03G 15/0893; G03G 2215/0802; G03G 2215/0822; G03G 2215/0838
USPC ..... 399/254, 256, 257
See application file for complete search history.

(56) References Cited

U.S. PATENT DOCUMENTS 5,095,338 A * 3/1992 Hayes, Jr. ..... G03G 15/0844 399/257
8,750,765 B2 * 6/2014 Watanabe ..... G03G 15/0893 399/256
2011/0150537 A1 * 6/2011 Watanabe ..... G03G 15/0893 399/256
2012/0177412 A1 * 7/2012 Watanabe ..... G03G 15/0189 399/256
2013/0343784 A1 * 12/2013 Fujimura ..... G03G 15/0893 399/257 X
2014/0161490 A1 * 6/2014 Yamane ..... G03G 15/0887 399/257
2014/0348543 A1 * 11/2014 Kashimoto ..... G03G 15/0889 399/257
2015/0030354 A1 * 1/2015 Ishida ..... G03G 15/0921 399/254
2015/0168873 A1 * 6/2015 Hamakawa ..... G03G 15/0889 399/257 X
2015/0253693 A1 * 9/2015 Shimizu ..... G03G 15/0889 399/257 X
2015/0331360 A1 * 11/2015 Akedo ..... G03G 15/0893 399/254

FOREIGN PATENT DOCUMENTS

JP 2001-265098 A 9/2001

* cited by examiner

*Primary Examiner* — Sophia S Chen
(74) *Attorney, Agent, or Firm* — Stein IP, LLC

(57) ABSTRACT

A developing device according to the present disclosure includes a developer container, a first stirring member, a second stirring member, and a developer carrying member. The developer container has a plurality of conveyance chambers including first and second conveyance chambers, is provided with a developer supply portion and a developer discharge portion and stores a two-component developer. The second stirring member is provided with an electro-conductive regulating portion that is disposed to oppose the developer discharge portion that regulates movement of the developer to the developer discharge portion. An electro-conductive plate is disposed on an inner wall surface of the developer container that opposes the regulating portion. During rotation of the first and second stirring members, by applying an alternating current bias to at least one of the regulating portion and the electro-conductive plate to generate an electric potential difference between the regulating portion and the electro-conductive plate.

8 Claims, 5 Drawing Sheets

DEVELOPING DEVICE AND IMAGE FORMING APPARATUS HAVING THE SAME

INCORPORATION BY REFERENCE

The present application is based on Japanese Patent Application No. 2015-46798 filed on Mar. 10, 2015, the contents of which are hereby incorporated by reference.

BACKGROUND

The present disclosure relates to: a developing device used in image forming apparatuses such as a copy machine, a printer, a facsimile, a multi-functional peripheral and the like that use an electro-photographic system; and an image forming apparatus that includes the developing device, more particularly, to a developing device that supplies a two-component developer containing toners and carriers and discharges a surplus developer; and an image forming apparatus that includes the developing device.

In an image forming apparatus, a latent image, which is formed on an image carrier composed of a photosensitive material and the like, is developed by a developing device and is visualized as a toner image. As one of such developing devices, a two-component developing system using a two-component developer is employed. In such a developing device of this kind, a developer containing toners and carriers is stored in a developer container, a developing roller for supplying the developer to the image carrier is disposed, and a stirring member is disposed which supplies the developer stored in the developer container to the developer roller while conveying and stirring the developer.

In this developing device, the toners are consumed in a developing operation, while the carriers remain without being consumed. Accordingly, the carriers, which are stirred along with the toners in the developer container, deteriorate as the stirring frequency becomes high, as a result of which, electrification performance of the carriers to the toners degrades gradually.

Because of this, a developing device is proposed, in which a developer containing carriers is supplied into a developer container; and a surplus developer is discharged to alleviate the degradation of the electrification performance.

For example, a developing device is known, in which two stirring members, which have a rotation shaft and a spiral blade formed spirally on an outer circumference of the rotation shaft, are disposed parallelly in respective conveyance chambers. In this developing device, a partition portion is disposed between the conveyance chambers, and communication portions for delivering the developer are disposed at both end portions of the partition portion. And, a developer discharge portion is formed on a downstream side of the conveyance chamber in a developer conveyance direction, and between the stirring member and the developer discharge portion, a reverse spiral blade, which is formed spirally in a direction opposite the spiral blade of the stirring member, is formed as a regulating portion integrally with the rotation shaft.

Besides, in a system that supplies carriers and toners into a developer container, a developing device is known, which to regulate an amount of a developer discharged from a developer discharge portion formed through an end portion of the developer container, includes a regulating portion composed of an opposite-direction spiral blade and an area regulating member that covers an upper portion of a communication opening located at a position close to the developer discharge portion and regulates an opening area of the communication opening.

According to the above structure, when a developer is supplied into the developer container, the developer is stirred and conveyed to the downstream side of the conveyance chamber by the rotation of the stirring member. When the reverse spiral blade rotates in the same direction as the stirring member, a conveyance force is given by the reverse spiral blade to the developer in a direction opposite to the developer conveyance direction. On the downstream side of the conveyance chamber, the developer is blocked by the opposite-direction conveyance force to swell up. Accordingly, a surplus developer climbs over the reverse spiral blade (regulating portion) and moves to the developer discharge portion to be discharged to outside.

SUMMARY

A developing device according to an aspect of the present disclosure includes a developer container, a first stirring member, a second stirring member, and a developer carrying member. The developer container has a plurality of conveyance chambers including a first conveyance chamber and a second conveyance chamber disposed in parallel with each other, and communication portions that allow the first and second conveyance chambers to communicate with each other on both end portion sides in a longitudinal direction of the first and second conveyance chambers, the developer container being provided with a developer supply portion that supplies a developer into the developer container and a developer discharge portion which is disposed through an end portion on a downstream side of the second conveyance chamber and through which a surplus developer is discharged, the developer container storing a two-component developer that contains carriers and toners. The first stirring member is composed of a rotation shaft and a spiral blade formed on an outer circumference of the rotation shaft, stirs and conveys the developer in the first conveyance chamber in a rotation shaft direction. The second stirring member is composed of a rotation shaft and a spiral blade formed on an outer circumference of the rotation shaft, stirs and conveys the developer in the second conveyance chamber in a direction opposite to the first stirring member. The developer bearer is supported rotatably by the developer container and bears, on a surface thereof, the developer in the second conveyance chamber. The second stirring member is provided with an electro-conductive regulating portion that is disposed to oppose the developer discharge portion on a more downstream side than the communication portion in a developer conveyance direction, and regulates movement of the developer to the developer discharge portion. An electro-conductive plate is disposed on an inner wall surface of the developer container that opposes the regulating portion, and during rotation and driving of the first stirring member and second stirring member, by applying an alternating current bias to at least one of the regulating portion and the electro-conductive plate to generate an electric potential difference between the regulating portion and the electro-conductive plate.

Still other objects of the present invention and specific advantages obtained by the present disclosure will become more apparent from the following description of a preferred embodiment.

DETAILED DESCRIPTION

Figure 1:
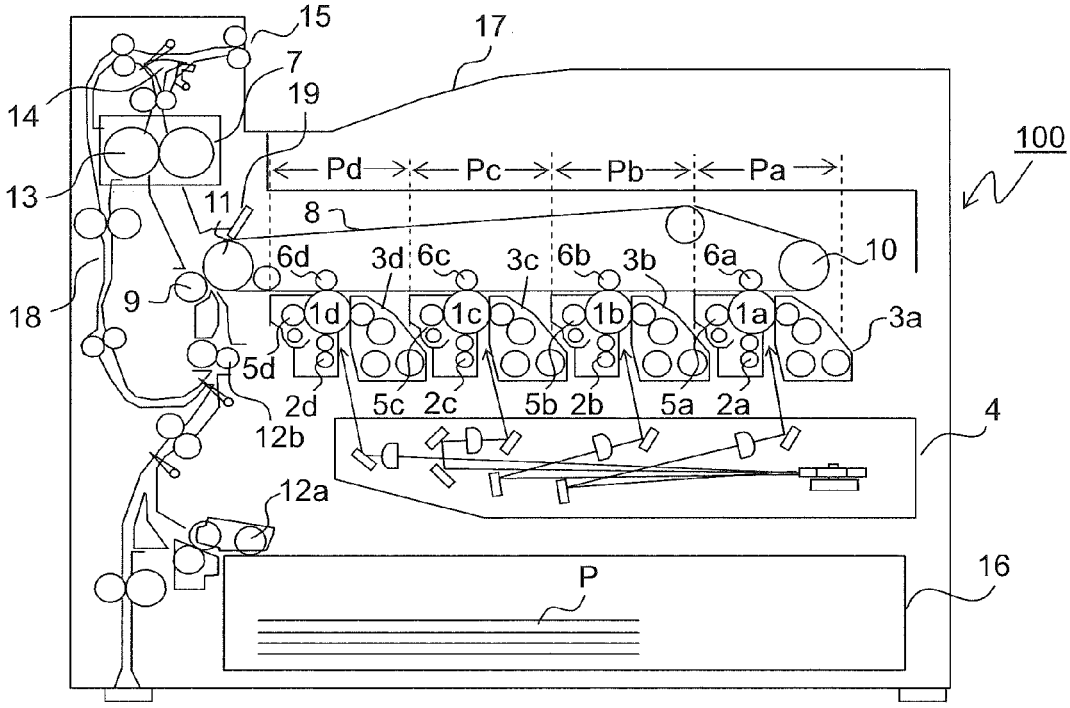
FIG. 1 is a cross-sectional view showing schematically a whole structure of a color printer 100 which incorporates developing devices 3*a*-3*d* according to the present disclosure.

Hereinafter, an embodiment of the present disclosure is described with reference to the drawings. FIG. 1 is a schematic cross-sectional view of an image forming apparatus which incorporates a developing device according to the present disclosure, and here shows a color printer of tandem type. In a color printer 100 main body, four image forming portions Pa, Pb, Pc, and Pd are arranged in order from an upstream side (right side of FIG. 1) in a conveyance direction. The image forming portions Pa-Pd are disposed correspondingly to four different color (cyan, magenta, yellow and black) images, and respectively form successively images of cyan, magenta, yellow and black successively through each process of electrification, light exposure, development and transfer.

The image forming portions Pa-Pd are respectively provided with photosensitive drums 1*a*, 1*b*, 1*c*, and 1*d* that bear the respective color visual images (toner image). Further, an intermediate transfer belt 8, which is rotated by a driving device (not shown) in a clockwise direction in FIG. 1, is disposed adjacently to each image forming portion Pa-Pd. The toner images formed on the photosensitive drums 1*a*-1*d* are successively aligned and transferred onto the intermediate transfer belt 8 that moves butting each photosensitive drum 1*a*-1*d*. Thereafter, the toner images transferred to the intermediate transfer belt 8 are transferred onto a transfer sheet P at a secondary transfer roller 9 at a time. Further, after the toner image is fixed on the transfer sheet P at a fixing portion 7, the transfer sheet P is ejected from an apparatus main body. An image forming process is executed on each photosensitive drum 1*a*-1*d* with the photosensitive drums 1*a*-1*d* being rotated in a counterclockwise direction in FIG. 1.

The transfer sheets P, to which a toner image is to be transferred, are stored in a sheet cassette 16 in a lower portion of the color printer 100 main body, and are conveyed to the secondary transfer roller 9 via a sheet feeding roller 12*a* and a registration roller pair 12*b*. A dielectric resin sheet is used for the intermediate transfer belt 8, and an endless belt, which is formed by overlaying both end portions of the sheet on each other and bonding them to each other, is used, or a seamless belt having no seams is used. Besides, a blade-shaped belt cleaner 19, which removes toners remaining on a surface of the intermediate transfer belt 8, is disposed on a downstream side of the secondary transfer roller 9.

Next, the image forming portions Pa-Pd are described. Electrifiers 2*a*, 2*b*, 2*c* and 2*d* for electrifying the photosensitive drums 1*a*-1*d*, a light exposure unit 4 which directs light to each photosensitive drum 1*a*-1*d* to form image information, developing devices 3*a*, 3*b*, 3*c* and 3*d* for forming toner images on the photosensitive drums 1*a*-1*d*, cleaning portions 5*a*, 5*b*, 5*c* and 5*d* for removing a developer (toner) remaining on the photosensitive drums 1*a*-1*d* are disposed around and below the photosensitive drums 1*a*-1*d* disposed rotatably.

When an image forming start is input from an upward apparatus such as a personal computer or the like, first, the electrifiers 2*a*-2*d* electrify evenly surfaces of the photosensitive drums 1*a*-1*d*. Next, the light exposure unit 4 directs light to the surfaces of the photosensitive drums 1*a*-1*d* to form an electrostatic latent image on each photosensitive drum 1*a*-1*d* in accordance with an image signal. The developing devices 3*a*-3*d* are filled, by means of a supply device (not shown), with a predetermined amount of toners of respective colors of cyan, yellow, magenta and black. The toners are supplied onto the photosensitive drums 1*a*-1*d* by the developing devices 3*a*-3*d*, and the toners adhere electrostatically, whereby a toner image is formed in accordance with the electrostatic latent image that is formed by the light from the light exposure unit 4.

And, an electric field is given to the intermediate transfer belt 8 by a predetermined transfer voltage, thereafter, the toner images of cyan, magenta, yellow and black on the photosensitive drums 1*a*-1*d* are transferred to the intermediate transfer belt 8 by primary transfer rollers 6*a*-6*d*. The four color images are formed in a predetermined positional relationship for forming a predetermined full-color image. Thereafter, to prepare for the forming of a new electrostatic latent image performed next, toners remaining on the surfaces of the photosensitive drums 1*a*-1*d* are removed by the cleaning portions 5*a*-5*d*.

The intermediate transfer belt 8 is mounted on a plurality of mounting rollers that include an upstream-side conveyance roller 10 and a downstream-side driving roller 11. When the intermediate transfer belt 8 starts to rotate in a clockwise direction following rotation of the driving roller 11 rotated by a driving motor (not shown), the transfer sheet P is conveyed from the registration roller pair 12*b* at a predetermined timing to the secondary transfer roller 9 disposed adjacently to the intermediate transfer belt 8, whereby a full-color image is transferred. The transfer sheet P, to which the toner image is transferred, is conveyed to the fixing portion 7.

The transfer sheet P conveyed to the fixing portion 7 is heated and pressed by a fixing roller pair 13, whereby the toner image is fixed on a surface of the transfer sheet P to form the predetermined full-color image. The transfer sheet P, on which the full-color image is formed, is switched in conveyance directions by a branch portion 14 that branches off into a plurality of directions. In a case where an image is formed on only one side of the transfer sheet P, the transfer sheet P is ejected as it is to an ejecting tray 17 by an ejecting roller pair 15.

On the other hand, in a case where images are formed on both sides of the transfer sheet P, a portion of the transfer sheet P passing through the fixing portion 7 is made to temporarily protrude from the ejecting roller pair 15 to outside the apparatus. Thereafter, by rotating backward the ejecting roller pair 15, the transfer sheet P is switched to a reverse conveyance path 18 by the branch portion 14, and reconveyed to the registration roller pair 12*b* with the image surface overturned. And, the next image formed on the intermediate transfer belt 8 is transferred by the secondary transfer roller 9 to a surface of the transfer sheet P where an image is not formed, conveyed to the fixing portion 7 to fix a toner image, thereafter, ejected to the ejecting tray 17 via the ejecting roller pair 15.

Figure 2:
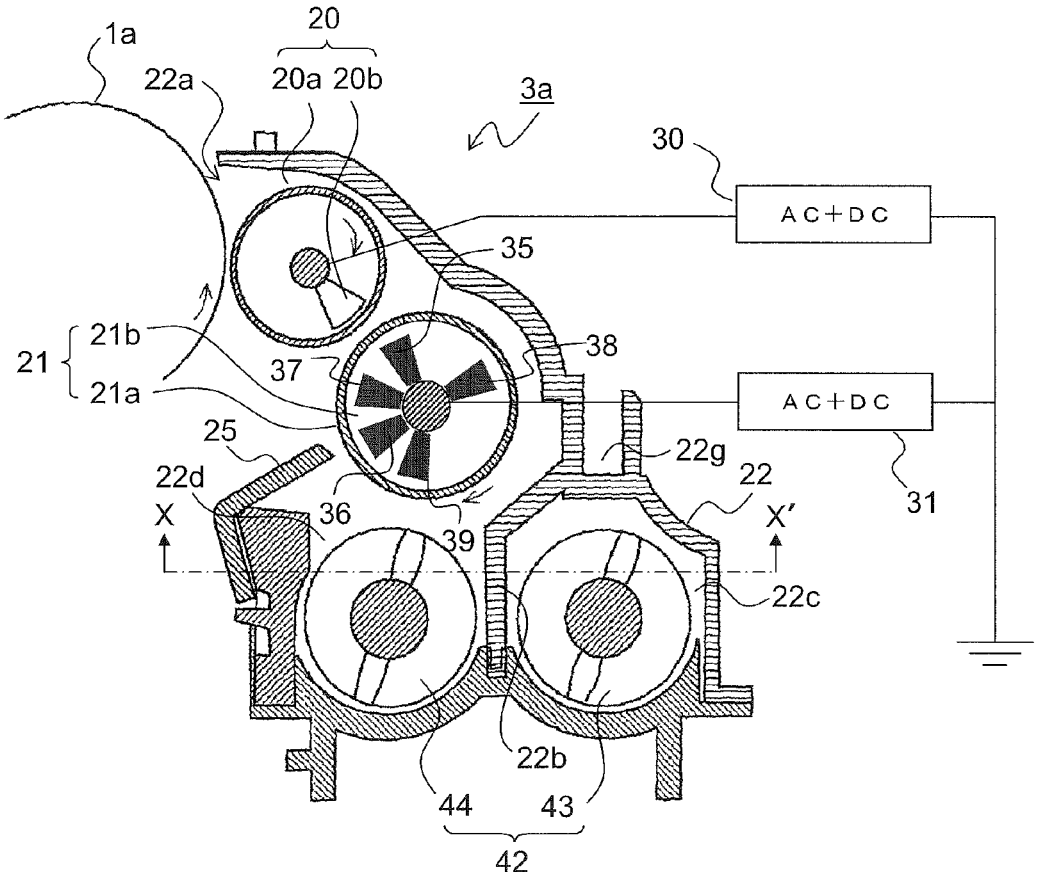
FIG. 2 is a side cross-sectional view of the developing device 3*a* according to an embodiment of the present disclosure.

FIG. 2 is a side cross-sectional view showing a structure of the developing device 3*a* incorporated in the color printer 100. In the meantime, here, the developing device 3*a*, which is disposed in the image forming portion Pa in FIG. 1, is described, but structures of the developing devices 3*b*-3*d* disposed in the image forming portions Pb-Pd are basically the same. Accordingly, description of them is skipped.

As shown in FIG. 2, the developing device 3*a* includes a developer container 22 that stores a two-component developer (hereinafter, simply called a developer). The developer container 22 is provided with an opening 22*a* from which the developing roller 20 is exposed to the photosensitive drum, and is divided into first and second stirring chambers 22*c*, 22*d* by a partition wall 22*b*. In the first and second stirring chambers 22*c*, 22*d*, a stirring member 42 is rotatably disposed, which includes a first stirring screw 43 and a second stirring screw 44 that mix toners (positively electrified toner) supplied from a not-shown toner container with carriers, stir and electrify them.

And, the developer is stirred and conveyed by the first stirring screw 43 and the second stirring screw 44 in a shaft direction, and circulates in the first and second stirring chambers 22*c*, 22*d* via communication portions (see FIG. 4) 22*e*, 22*f* formed at both ends of the partition wall 22*b*. In the illustrated example, the developer container 22 extends in an obliquely upper left direction, and in the developer container 22, the magnetic roller 21 is disposed over the second stirring screw 44, and the developing roller 20 is disposed at an obliquely upper left position of the magnetic roller 21 to oppose the magnetic roller 21. And, the developing roller 20 opposes the photosensitive drum 1*a* near (left side of FIG. 2) the opening 22*a* of the developer container 22, and the magnetic roller 21 and the developing roller 20 rotate in a clockwise direction in FIG. 2.

In the meantime, the developer container 22 is provided with a toner concentration sensor (not shown) opposing the first stirring screw 43. In accordance with a toner concentration detected by the toner concentration sensor, toners are supplied from a supply device (not shown) into the developer container 22 via a toner supply opening 22*g*.

The magnetic roller 21 is composed of a non-magnetic rotation sleeve 21*a*, and a stationary magnet body 21*b* that has a plurality of magnetic poles included in the rotation sleeve 21*a*. In the present embodiment, the magnetic poles of the stationary magnet body 21*b* include 5 magnetic poles of a main magnetic pole 35, a regulating magnetic pole (cutting magnetic pole) 36, a conveyance magnetic pole 37, a peeling magnetic pole 38, and a scooping-up magnetic pole 39. The magnetic roller 21 and the developing roller 20 oppose each other at a facing position (opposing position) across a predetermined gap.

Besides, the developer container 22 is mounted with a cutting blade 25 along a longitudinal direction (direction perpendicular to the paper surface of FIG. 2) of the magnetic roller 21. In a rotation direction (clockwise direction in FIG. 2) of the magnetic roller 21, the cutting blade 25 is situated on a more upstream side than the opposing position between the developing roller 20 and the magnetic roller 21. And, a slight gap is formed between a tip end portion of the cutting blade 25 and a surface of the magnetic roller 21.

The developing roller 20 is composed of a non-magnetic developing sleeve 20*a*, and a developing roller-side magnetic pole 20*b* fixed in the developing sleeve 20*a*. The developing roller-side magnetic pole 20*b* has a polarity different from the opposing magnetic pole (main magnetic pole) 35 of the stationary magnet body 21*b*.

The developing roller 20 is connected to a first bias circuit 30 that applies a direct current bias (hereinafter, called Vslv (DC)) and an alternating current bias (hereinafter, called Vslv (AC)). The magnetic roller 21 is connected to a second bias circuit 31 that applies a direct current bias (hereinafter, called Vmag (DC)) and an alternating current bias (hereinafter, called Vmag (AC)). Besides, the first bias circuit 30 and the second bias circuit 31 are grounded in common.

As described above, the developer is stirred by the first stirring screw 43 and the second stirring screw 44, circulates to electrify the toners in the developer container 22, and is conveyed to the magnetic roller 21 by the second stirring screw 44. The regulating magnetic pole 36 of the stationary magnet body 21*b* opposes the cutting blade 25. Accordingly, by using, as the cutting blade 25, a non-magnetic body or a magnetic body having a polarity different from the regulating magnetic pole 36, a magnetic field occurs between the tip end of the cutting blade 25 and the rotation sleeve 21*a* in a direction to attract each other.

This magnetic field forms a magnetic brush between the cutting blade 25 and the rotation sleeve 21*a*. And, the magnetic brush on the magnetic roller 21 is trimmed in thickness by the cutting blade 25, thereafter, when the magnetic roller 21 moves to the position to oppose the developing roller 20, the attracting magnetic field is given to the magnetic brush by the main magnetic pole 35 of the stationary magnet body 21*b* and the developing roller-side magnetic pole 20*b*. Accordingly, the magnetic brush contacts a surface of the developing roller 20. And, by means of the magnetic field and an electric potential difference ΔV between Vmag (DC) applied to the magnetic roller 21 and Vslv (DC) applied to the developing roller 20, a toner thin layer is formed on the developing roller 20.

A toner layer thickness on the developing roller 20 changes depending on resistance of the developer, a rotation speed difference between the magnetic roller 21 and the developing roller 20 and the like, but is controllable by means of ΔV. If ΔV is increased, the toner layer on the developing roller 20 becomes thick, while when ΔV is decreased, the toner layer becomes thin. It is suitable that a range of ΔV during a development time is generally about 100 V to about 350 V.

Figure 3A:
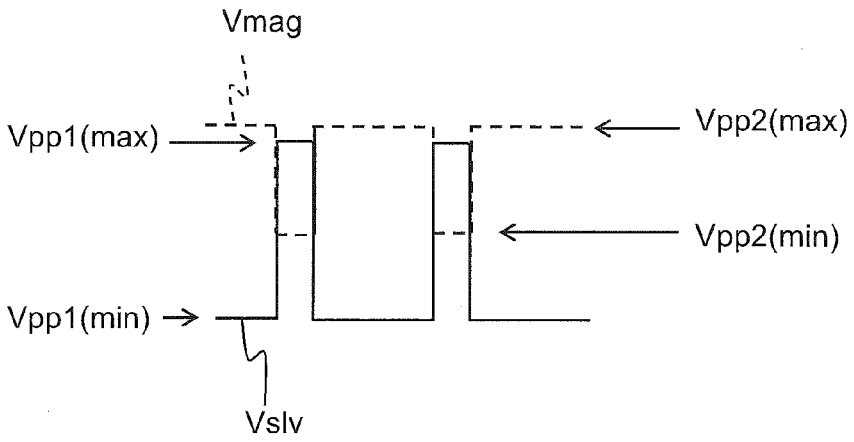
FIGS. 3A and 3B are views showing examples of bias waveforms that are applied to a developing roller 20 and a magnetic roller 21.
Figure 3B:
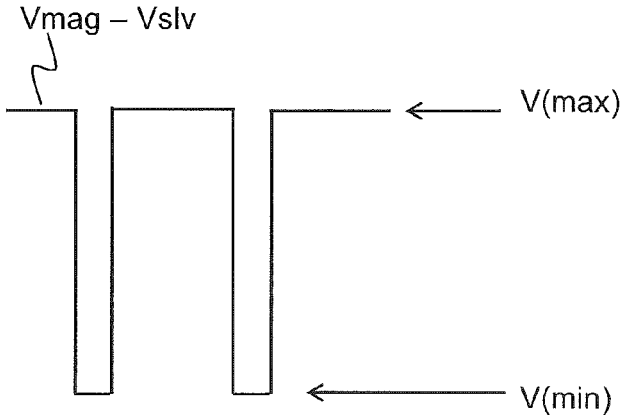

FIG. 3A, FIG. 3B are views showing examples of bias waveforms applied to the developing roller 20 and the magnetic roller 21. As shown in FIG. 3A, a synthetic waveform Vslv (solid line), which is composed of Vslv (DC) and a rectangular-wave Vslv (AC) having a peak-to-peak value of Vppl and superimposed on Vslv (DC), is applied to the developing roller 20 from the first bias circuit 30. Besides, a synthetic waveform Vmag (broken line), which is composed of Vmag (DC) and a rectangular-wave Vmag (AC) having a peak-to-peak value of Vpp2 and a phase different from Vslv (AC) and being superimposed on Vmag (DC), is applied to the magnetic roller 21 from the second bias circuit 31.

Accordingly, a voltage applied between the magnetic roller 21 and the developing roller 20 (hereinafter, called between MS) has a synthetic waveform Vmag-Vslv that has Vpp (max) and Vpp (min) shown in FIG. 3B. In the meantime, Vmag (AC) is set to be larger than Vslv (AC) in duty ratio. As a matter of fact, perfect rectangular waves as shown in FIG. 3A, FIG. 3B are not applied, but a.c. biases having a partially deformed waveform are applied.

The toner thin layer formed on the developing roller 20 by the magnetic brush is conveyed by rotation of the developing roller 20 to the opposing portion between the photosensitive drum 1*a* and the developing roller 20. Vslv (DC) and Vslv (AC) are applied to the developing roller 20. Accordingly, toners fly with the aid of an electric potential difference between the photosensitive drum 1*a* and the developing roller 20, whereby the electrostatic latent image on the photosensitive drum 1*a* is developed.

Further, when the rotation sleeve 20*a* rotates in the clockwise direction, the magnetic brush is pulled off the surface of the developing roller 20 with the aid of a magnetic field in a horizontal direction (roller circumferential direction) that is generated by the peeling magnetic pole 38 that is adjacent to the main magnetic pole 35 and has a polarity different from the main magnetic pole 35, and toners, which are not used for the development and remain, are collected onto the rotation sleeve 21*a* from the developing roller 20. When the rotation sleeve 21 rotates further, the toners are given a repelling magnetic field by the peeling magnetic pole 38 and scooping-up magnetic pole 39 of the stationary magnetic body 21*b* having the same polarity as the peeling magnetic pole 38. Accordingly, the toners leave the rotation sleeve 21*a* in the developer container 22. And, the toners are stirred and conveyed by the second stirring screw 44, thereafter, used again as a two-component developer that is electrified evenly to have a suitable toner concentration, whereby a magnetic brush is formed on the rotation sleeve 21*a* by the scooping-up magnetic pole 39 and conveyed to the cutting blade 25.

Figure 4:
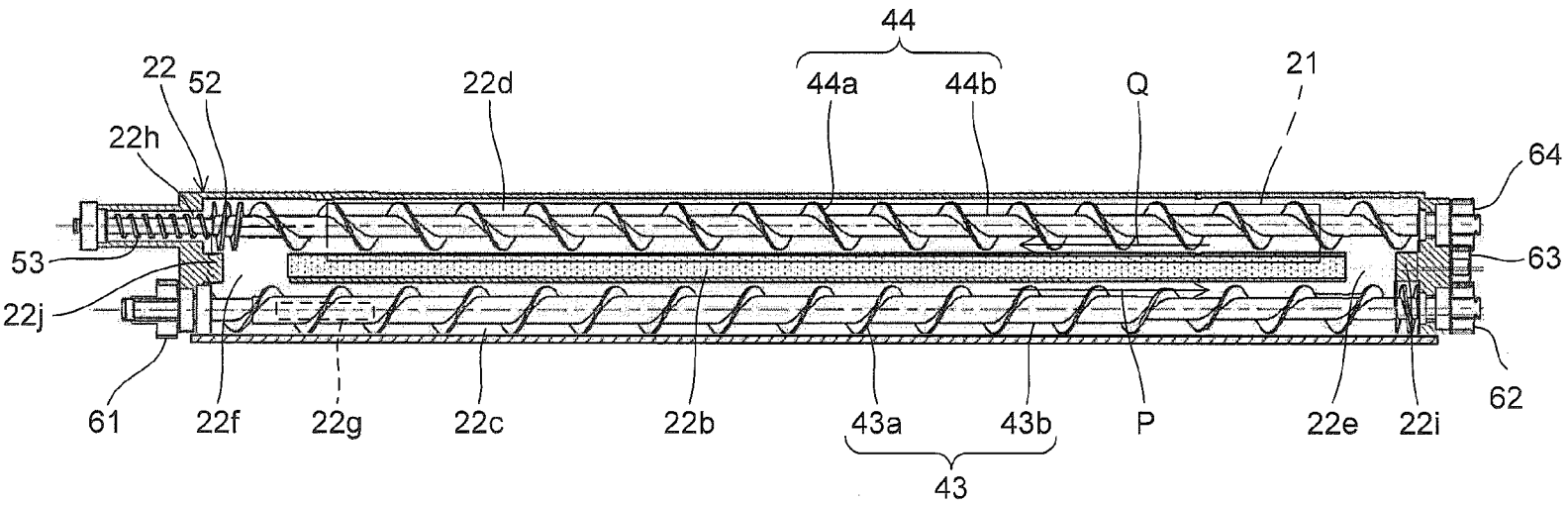
FIG. 4 is a plan cross-sectional view showing a stirring portion of the developing device 3*a* according a present embodiment.

Next, a structure of a stirring portion of the developing device 3*a* is described in detail. FIG. 4 is a plan cross-sectional view (cross-sectional view along an arrow XX' of FIG. 2) showing the stirring portion of the developing device 3*a*.

As described above, the developer contained 22 is provided therein with the first conveyance chamber 22*c*, the second conveyance chamber 22*d*, the partition wall 22*b*, the upstream-side communication portion 22*e*, and the downstream-side communication portion 22*f*, besides, provided with the developer supply portion 22*g*, a developer discharge portion 22*h*, an upstream-side wall portion 22*i*, and a downstream-side wall portion 22*j*. In the meantime, in the first conveyance chamber 22*c*, the left side of FIG. 4 is defined as the upstream side, the right side of FIG. 4 is defined as the downstream side, besides, in the second conveyance chamber 22*d*, the right side of FIG. 4 is defined as the upstream side, the left side of FIG. 4 is defined as the downstream side. Accordingly, the communication portion and the side wall portion are called the upstream and the downstream respectively with respect to the second conveyance chamber 22*d*.

The partition wall 22*b* extends in a longitudinal direction of the developer container 22 to separate the first conveyance chamber 22*c* and the second conveyance chamber 22*d* in parallel with each other. A right end portion of the partition wall 22*b* in the longitudinal direction cooperates with an inner wall portion of the upstream-side wall portion 22*i* to form the upstream-side communication portion 22*e*, on the other hand, a left end portion of the partition wall 22*b* in the longitudinal direction cooperates with an inner wall portion of the upstream-side wall portion 22*j* to form the downstream-side communication portion 22*f*. And, the developer is able to circulate in the first conveyance chamber 22*c*, the upstream-side communication portion 22*e*, the second conveyance chamber 22*d*, and the downstream-side communication portion 22*f*.

The developer supply portion 22*g* is an opening for supplying new toners and carriers from a developer supply container (not shown), which is disposed over the developer container 22, into the developer container 22. The developer supply portion 22*g* is disposed on the upstream side (left side of FIG. 4) of the first conveyance chamber 22*c*.

The developer discharge portion 22*h* is an opening for discharging a surplus developer in the first and second conveyance chambers 22*c*, 22*d* generated by the developer supply. The developer discharge portion 22*h* is continuously disposed in a longitudinal direction of the second conveyance chamber 22*d* on the downstream side of the second conveyance chamber 22*d*.

The first conveyance chamber 22*c* is provided therein with the first stirring screw 43, and the second conveyance chamber 22*d* is provided therein with the second stirring screw 44.

The first stirring screw 43 has a rotation shaft 43*b*, and a first spiral blade 43*a* that is formed integrally with the rotation shaft 43*b* and formed spirally at a constant pitch in a shaft direction of the rotation shaft 43*b*. Besides, the first spiral blade 43*a* extends to both end portions of the first conveyance chamber 22*c* in a longitudinal direction, and is disposed to oppose the upstream-side and downstream-side communication portions 22*e*, 22*f*. The rotation shaft 43*b* is rotatably supported by the upstream-side wall portion 22*i* and downstream-side wall portion 22*j* of the developer container 22.

The second stirring screw 44 has a rotation shaft 44*b*, and a second spiral blade 44*a* that is formed integrally with the rotation shaft 44*b* and formed spirally by means of a blade facing in a direction (opposite phase) opposite to the first spiral blade 43*a*, at the same pitch as the first spiral blade 43*a* in a shaft direction of the rotation shaft 44*b*. Besides, the second spiral blade 44*a* has a length longer than a shaft-direction length of the magnetic roller 21, further, is formed to extend to a position to oppose the upstream-side communication portion 22*e*. The rotation shaft 44*b* is disposed in parallel with the rotation shaft 43*b*, and rotatably supported by the upstream-side wall portion 22*i* and downstream-side wall portion 22*j* of the developer container 22.

Besides, the rotation shaft 44*b* is integrally provided with a regulating portion 52 and a discharge blade 53 along with the second spiral blade 44*a*.

The regulating portion 52 blocks the developer conveyed to the downstream side in the second conveyance chamber 22*d* and allows more than a predetermined amount of the developer to be conveyed to the developer discharge portion 22*h*. The regulating portion 52 includes a spiral blade disposed on the rotation shaft 44*b*, formed spirally by means of a blade facing in a direction (opposite phase) opposite to the second spiral blade 44*a*, has an outer diameter substantially equal to the second spiral blade 44*a*, and set at a pitch smaller than the pitch of the second spiral blade 44*a*. Besides, the regulating portion 52 forms a predetermined size of gap between an outer circumference of the regulating portion 52 and the inner wall of the developer container 22 such as the downstream-side wall portion 22*j* and the like. A surplus developer is discharged from the gap.

The rotation shaft 44*b* extends into the developer discharge portion 22*h*. The rotation shaft 44*b* in the developer discharge portion 22*h* is provided with the discharge blade 53. The discharge blade 53 includes a spiral blade that faces in the same direction as the second spiral blade 44*a*, but has a pitch smaller than the second spiral blade 44*a*, and an outer circumference smaller than the second spiral blade 44*a*. Accordingly, when the rotation shaft 44*b* rotates, also the discharge blade 53 rotates, and a surplus developer, which climbs over the regulating portion 52 to be conveyed into the developer discharge portion 22*h*, is sent to the left side of FIG. 4 and discharged outside the developer container 22. In the meantime, the discharge blade 53, the regulating portion 52, and the second spiral blade 44*a* are formed integrally with the rotation shaft 44*b* by means of a synthetic resin.

Gears 61-64 are disposed on an outer wall of the developer container 22. The gears 61, 62 are fixed to the rotation shaft 43*b*, the gear 64 is fixed to the rotation shaft 44*b*, and the gear 63 is rotatably held by the developer container 22 and meshes with the gears 62, 64.

During a development time when a new developer is not supplied, when the gear 61 is rotated by a driving source such as a motor and the like, the first spiral blade 43*a* rotates together with the rotation shaft 43*b*, the developer in the first conveyance chamber 22*c* is conveyed by the first spiral blade 43*a* in a main conveyance direction (arrow P direction), thereafter, conveyed into the second conveyance chamber 22*d* through the upstream-side communication portion 22*e*. Further, when the second spiral blade 44*a* rotates together with the rotation shaft 44*b* associating with the rotation shaft 44*a*, the developer in the second conveyance chamber 22*d* is conveyed by the second spiral blade 44*a* in a main conveyance direction (arrow Q direction). Accordingly, the developer is conveyed from the first conveyance chamber 22*c* into the second conveyance chamber 22*d* through the upstream-side communication portion 22*e* with the height level of the developer being changed considerably, does not climb over the regulating portion 52, and is conveyed to the first conveyance chamber 22*c* through the downstream-side communication portion 22*f*.

As described above, the developer circulates in the first conveyance chamber 22*c*, the upstream-side communication portion 22*e*, the second conveyance chamber 22*d*, and the downstream-side communication portion 22*f* while being stirred, and the stirred developer is supplied to the magnetic roller 21.

Next, a case where a developer is supplied from the developer supply portion 22*g* is described. When toners are consumed by the development, a developer containing carriers is supplied from the developer supply portion 22*g* into the first conveyance chamber 22*c*.

Like in the development time, the supplied developer is conveyed by the first spiral blade 43*a* in the first conveyance chamber 22*c* in the arrow P direction, thereafter, conveyed into the second conveyance chamber 22*d* through the upstream-side communication portion 22*e*. Further, the developer is conveyed by the second spiral blade 44*a* in the second conveyance chamber 22*d* in the main conveyance direction (arrow Q direction). When the regulating portion 52 rotates following rotation of the rotation shaft 44*b*, the developer is given a conveyance force in a direction (opposite conveyance direction) opposite to the main conveyance direction by the regulating portion 52. The developer is blocked by the regulating portion 52 to swell up, whereby a surplus developer (same amount of the developer supplied from the developer supply portion 22*g*) climbs over the regulating portion 52 to be discharged outside the developer container 22 via the developer discharge portion 22*h*.

Figure 5:
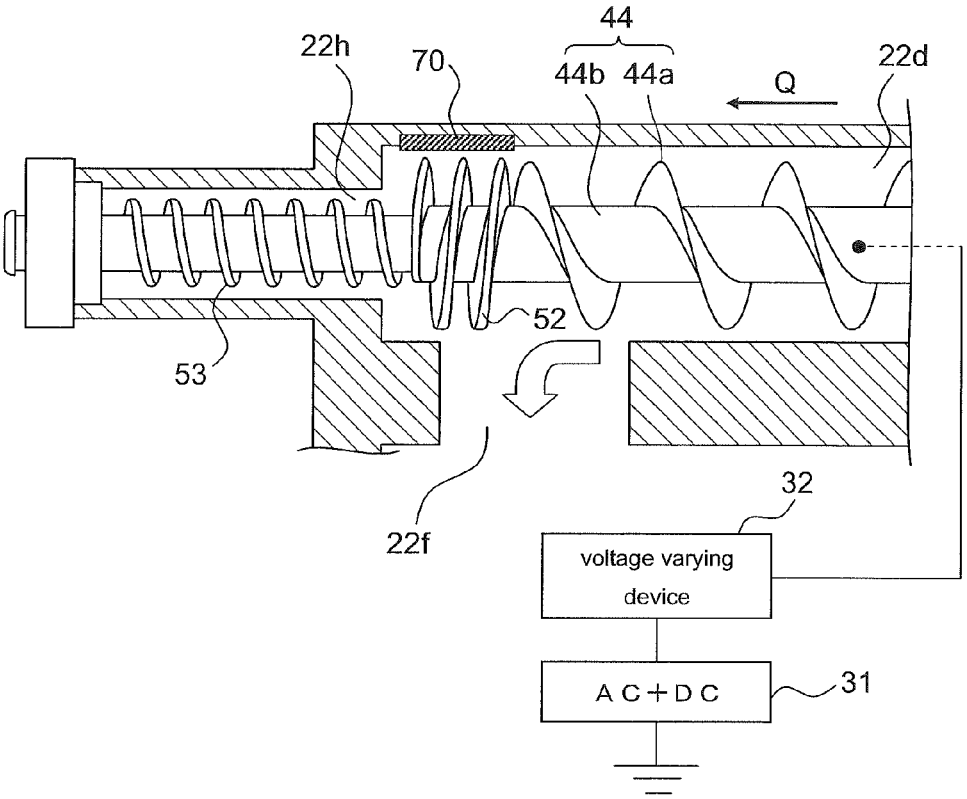
FIG. 5 is an enlarged view around a developer discharge portion 22*h* in FIG. 4.

FIG. 5 is an enlarged view around the developer discharge portion 22*h* in FIG. 4. As shown in FIG. 5, the inner wall surface of the developer container 22 (second conveyance chamber 22*d*) opposing the regulating portion 52 is provided thereon with an electro-conductive plate 70 formed of an electro-conductive material such as metal or the like. Besides, the second stirring screw 44 is formed of an electro-conductive material, and the second bias circuit 31 is connected to the rotation shaft 44*b* of the second stirring screw 44, whereby it is possible to apply an a.c. bias to the second stirring screw 44. Further, a voltage varying device 32 is connected between the rotation shaft 44*b* and the second bias circuit 31, whereby it is possible to vary the a.c. bias applied to the second stirring screw 44.

According to the structure of the present disclosure, when the a.c. bias is applied to the rotation shaft 44*b* of the second stirring screw 44, an electric potential difference, which occurs between the electro-conductive plate 70 and the regulating portion 52, generates an a.c. electric field to vibrate the developer at the regulating portion 52. A vibration direction of the developer is the same as the a.c. electric field, namely, a direction (vertical direction in FIG. 5) perpendicular to the main conveyance direction (arrow Q direction) of the developer.

In this way, pressure on the developer from the main conveyance direction (arrow Q direction) of the developer is reduced by the vibration of the developer. As a result of this, stagnation of the developer at the regulating portion 52 is alleviated, and waving (change) of a surface of the developer moving to the regulating portion 52 and downstream-side communication portion 22*f* is alleviated. And, the developer under the reduced pressure climbs over the regulating portion 52 to move to the discharge blade 53 and is discharged from the developer discharge portion 22*h*. Accordingly, it is possible to stabilize the amount of the developer that climbs over the regulating portion 52 to be discharged from the developer discharge portion 22*h*.

Besides, by varying the a.c. bias applied by means of the voltage varying device 32, it is possible to vary the amount of the developer discharged from developer discharge portion 22*h*. Accordingly, it is possible to arbitrarily control the developer amount in the developer container 22 in accordance with a use environment such as temperature, humidity and the like and a change in a process speed.

Here, in a case where a magnetic material is used as a material of the regulating portion 52 (second stirring screw 44) or electro-conductive plate 70, there is a risk that the a.c. electric field would generate a magnetic field around the regulating portion 52 and the electro-conductive plate 70 to disturb the conveyance of the developer. Because of this, it is preferable to use a non-magnetic material as the material of the regulating portion 52 and electro-conductive plate 70.

In the meantime, here, the second bias circuit 31, which superimposes the d.c. bias and the a.c. bias on each other and applies them to the magnetic roller 21, is connected to the rotation shaft 44*b* of the second stirring screw 44 to apply the a.c. bias to the second stirring screw 44. However, in place of the second bias circuit 31, the first bias circuit 30 may be connected to the rotation shaft 44*b* of the second stirring screw 44. Or, a bias applying device, which applies the a.c. bias to the second stirring screw 44, may be disposed separately from the first bias circuit 30 and the second bias circuit 31.

Besides, a structure may be employed, in which the a.c. bias is applied to the electro-conductive plate 70 in place of the second stirring screw 44. In this case, it is not necessary to form an entirety of the second stirring screw 44 by means of an electro-conductive material, but it is sufficient to form the regulating portion 52 only by means of an electro-conductive material. And, like in the above description, either of the first bias circuit 30 and second bias circuit 31 may be connected to the electro-conductive plate 70, or a bias applying device, which applies the a.c. bias to the electro-conductive plate 70, may be disposed separately from the first bias circuit 30 and the second bias circuit 31.

Further, a structure may be employed, in which the a.c. bias is applied to both the second stirring screw 44 (regulating portion 52) and the electro-conductive plate 70. In this case, if the a.c. bias applied to the second stirring screw 44 and the a.c. bias applied to the electro-conductive plate 70 are reversed from each other in phase, it is possible to increase the electric potential difference between the regulating portion 52 and the electro-conductive plate 70 by only applying a relatively low-voltage a.c. bias.

Besides, the present disclosure is not limited to the above embodiment, and it is possible to make various modifications without departing from the spirit of the present disclosure. For example, the present disclosure is not limited to the developing device that includes the magnetic roller 21 and developing roller 20 shown in FIG. 2, but it is possible to apply the present disclosure to various developing devices that use a two-component developer containing toners and carriers. For example, in the above embodiment, as to the developer circulation route in the developer container 22, the developing device of two-shaft conveyance type, which includes the first conveyance chamber 22*c* and the second conveyance chamber 22*d* disposed in parallel with each other, is described, but the present disclosure is also applicable to a developing device of three-shaft conveyance type including a collection conveyance chamber that collects the developer peeled off the magnetic roller 21 and joins the developer to the second conveyance chamber 22*d*.

Besides, in the above embodiment, the structure is described, in which the regulating portion 52 has the spiral blade having the phase opposite to the second spiral blade 44*a*, but the present disclosure is not limited to this, and as the regulating portion 52, a disc having a size larger than the opening of the developer discharge portion 22*h* may be formed on the rotation shaft 44*b*.

Besides, the present disclosure is not limited to the color printer of tandem type shown in FIG. 1, but applicable to various image forming apparatuses that use the two-component developer system such as a digital or analog monochrome copy machine, a monochrome printer, a color copy machine, a facsimile and the like. Hereinafter, effects of the present disclosure are described further specifically based on examples.

Example

In the color printer 100 shown in FIG. 1, in a case where the conveyance speed of the developer, the toner concentration and the absolute humidity are varied, changes in the developer amount in the developing devices 3*a*-3*d* are investigated. In the meantime, tests are performed by means of the image forming portion Pa for cyan that includes the photosensitive drum 1*a* and the developing device 3*a*.

As a test method, the developing device 3*a* is defined as the present disclosure, in which the second bias circuit 31 and the voltage varying device 32 are connected to the rotation shaft 44*b* of the second stirring-conveying screw 44; and the electro-conductive plate 70 formed of feeble-magnetic stainless steel (SUS 304) is disposed on the inner wall surface of the second conveyance chamber 22*d* that opposes the regulating portion 52 shown in FIG. 5, while the developing device 3*a* is defined as a comparative example, in which the second bias circuit 31 and the voltage varying device 32 are not connected to the rotation shaft 44*b* and the electro-conductive plate 70 is not disposed.

150 $cm^3$ of developer is packed into the developer container 22 of the developing device 3*a* of each of the present disclosure and the developing device 3*a*, the rotation speed of the first stirring screw 43 is fixed at 300 rpm, the rotation speed of the second stirring screw 44 is varied to stir and convey the developer, and the developer amounts (stable weight, stable volume) existing in the developing container 22 are measured at a time when the discharge of the developer from the developer discharge portion 22*h* ends.

The second spiral blade 44*a* of the second stirring screw 44 used in the present disclosure and the comparative example is a spiral blade that has an outer diameter of 14 mm and the distance (clearance) between the second spiral blade 44*a* and the second conveyance chamber 22*d* is 1.5 mm. Besides, the regulating portion 52 is composed of three spiral blades oppositely wound (opposite phase) having an outer diameter of 12 mm, and the distance between the regulating portion 52 and the second conveyance chamber 22*d* is 1.5 mm. The discharge blade 53 is a spiral blade having an outer diameter of 8 mm, and the distance between the discharge blade 53 and the developer discharge portion 22*h* is 1.5 mm.

As a method for measuring the developer amount, the developing device 3*a* of the present disclosure and comparative example is incorporated into a test machine, the rotation speed (stirring speed in the second conveyance chamber 22*d*) of the second stirring screw 44, the toner concentration, the absolute humidity, and the a.c. bias value applied to the second stirring-conveying screw 44 are varied to stir the developer, thereafter, the developing device 3*a* is removed to measure the weight. The developer amount (stable weight) is calculated by subtracting the weight of the empty developing device 3*a* with the developer removed from the weight of the measured developing device 3*a*. Besides, a stable volume is calculated by dividing the calculated developer amount by a bulk density. Relationships among the absolute humidity, toner concentration (mix ratio of toners to carriers; T/C), and bulk density used for the calculation of the stable volume are shown in a table 1.

In the meantime, the stirring speed of 300 rpm, the toner concentration of 10%, the absolute humidity of 10 $g/cm^3$, the a.c. bias value (peak-to-peak value) of 800 V, the frequency of 1 kHz, and the duty ratio of 50% are used as reference conditions, while three levels of the stirring speeds of 200 rpm, 300 rpm, and 400 rpm, three levels of the toner concentrations of 8%, 10%, and 12%, three levels of the absolute humidities of 5 $g/m^3$, 10 $g/m^3$, and 20 $g/m^3$ and three levels of the a.c. bias values of 0 V, 800 V, and 1600 V are used. The results are shown in a table 2 to a table 5.

TABLE 1

| absolute humidity [$g/m^3$] | toner concentration [weight %] | bulk density [$g/cm^3$] |
|---|---|---|
| 5 | 8 | 1.73 |
| | 10 | 1.65 |
| | 12 | 1.58 |
| 10 | 8 | 1.86 |
| | 10 | 1.77 |
| | 12 | 1.69 |
| 20 | 8 | 1.93 |
| | 10 | 1.89 |
| | 12 | 1.84 |

TABLE 2

| stirring speed [rpm] | toner concentration [weight %] | absolute humidity [g/m³] | AC bias [V] | present disclosure volume [cm³] | present disclosure weight [g] | comparative example volume [cm³] | comparative example weight [g] |
|---|---|---|---|---|---|---|---|
| 200 | 10 | 10 | 800 | 124 | 219 | 128 | 227 |
| 300 | 10 | 10 | 800 | 122 | 216 | 118 | 209 |
| 400 | 10 | 10 | 800 | 121 | 214 | 114 | 202 |

TABLE 3

| stirring speed [rpm] | toner concentration [weight %] | absolute humidity [g/m³] | AC bias [V] | present disclosure volume [cm³] | present disclosure weight [g] | comparative example volume [cm³] | comparative example weight [g] |
|---|---|---|---|---|---|---|---|
| 300 | 8 | 10 | 800 | 123 | 229 | 119 | 221 |
| 300 | 10 | 10 | 800 | 122 | 216 | 118 | 209 |
| 300 | 12 | 10 | 800 | 125 | 211 | 121 | 204 |

TABLE 4

| stirring speed [rpm] | toner concentration [weight %] | absolute humidity [g/m³] | AC bias [V] | present disclosure volume [cm³] | present disclosure weight [g] | comparative example volume [cm³] | comparative example weight [g] |
|---|---|---|---|---|---|---|---|
| 300 | 10 | 5 | 800 | 120 | 198 | 118 | 195 |
| 300 | 10 | 10 | 800 | 122 | 216 | 118 | 209 |
| 300 | 10 | 20 | 800 | 119 | 225 | 116 | 219 |

TABLE 5

| stirring speed [rpm] | toner concentration [weight %] | absolute humidity [g/m³] | AC bias [V] | present disclosure volume [cm³] | present disclosure weight [g] | comparative example volume [cm³] | comparative example weight [g] |
|---|---|---|---|---|---|---|---|
| 300 | 8 | 10 | 0 | 117 | 218 | 119 | 221 |
| 300 | 8 | 10 | 800 | 123 | 229 | 119 | 221 |
| 300 | 8 | 10 | 1600 | 128 | 238 | 119 | 221 |
| 300 | 10 | 5 | 0 | 115 | 190 | 119 | 196 |
| 300 | 10 | 5 | 800 | 120 | 198 | 119 | 196 |
| 300 | 10 | 5 | 1600 | 128 | 211 | 119 | 196 |
| 300 | 10 | 20 | 0 | 113 | 214 | 119 | 225 |
| 300 | 10 | 20 | 800 | 119 | 225 | 119 | 225 |
| 300 | 10 | 20 | 1600 | 128 | 242 | 119 | 225 |

Under the reference conditions, comparing the developer amounts in the present disclosure and the developer amounts in the comparative example with each other, the developer amounts in the present disclosure are slightly more than the developer amounts in the comparative example. This is because in the structure of the present disclosure, the a.c. electric field occurring between the second stirring screw 44 and the electro-conductive plate 70 vibrates the developer between the regulating portion 52 and the electro-conductive plate 70, whereby the discharge of the developer is alleviated.

As apparent from the table 2, in the case where the stirring speed of the developer is varied, in the present disclosure, unevenness in the stable volume and stable weight of the developer caused by difference among the stirring speeds is smaller than the comparative example. It is conceivable that because the vibration occurs between the regulating portion 52 and the electro-conductive late 70 in the developing device 3*a* of the present disclosure, there is an effect of keeping the conveyance speed of the developer constant when passing through the regulating portion 52.

Besides, as apparent from FIG. 3 and FIG. 4, in the case where the toner concentration or the absolute humidity is varied, unevenness in the stable volume of the developer is not recognizable in any one of the present disclosure and the comparative example. On the other hand, the higher the toner concentration is and the lower the absolute humidity is, the smaller the stable weight of the developer becomes, while the lower the toner concentration is and the higher the absolute humidity is, the larger the stable weight of the developer becomes. This is because the electrification amount of the toner changes because of the variation in the toner concentration and absolute humidity; and as shown in the table 1, the lower the toner concentration is and the higher the absolute humidity is, the larger the bulk density of the developer becomes.

Besides, as apparent from the table 5, in the comparative example in which the a.c. bias is not applied, the stable weight of the developer changes following the variation in the toner concentration and absolute humidity. Specifically, when the toner concentration decreases from 10% to 8% in the reference condition, the stable weight increases from 209 g to 221 g. Besides, when the absolute humidity decreases from 10 g/m³ in the reference condition to 5 g/m³, the stable weight decreases from 209 g to 196 g. Further, when the absolute humidity rises from 10 g/m³ in the reference condition to 20 g/m³, the stable weight increases from 209 g to 225 g.

If the stable weight becomes too small, there is a risk that the amount of the developer supplied to the magnetic roller 21 would run short and also the amount of the toners supplied to the developing roller 20 would run short. On the other hand, if the stable weight becomes too large, there is a risk that the rotation torque of the first stirring screw 43 and second stirring screw 44 would rise and the developer would deteriorate because of heat generation.

Accordingly, as in the present disclosure, the electro-conductive plate 70 is disposed on the inner wall surface of the second conveyance chamber 22*d* and the a.c. bias value applied to the second stirring screw 44 is varied, whereby it becomes possible to arbitrarily adjust the stable weight of the developer, and it is possible to easily eliminate the above disadvantage. Specifically, as apparent from the table 2, the larger the stirring speed of the developer in the second conveyance chamber 22*d* becomes, the smaller the stable weight of the developer becomes. Accordingly, by increasing the peak-to-peak value of the applied a.c. bias, the vibration of the developer is made large and the discharge of the developer from the developer discharge portion 22*h* is alleviated. Besides, as apparent from the table 3 and table 4, the higher the toner concentration becomes and the lower the absolute humidity becomes, the smaller the stable weight of the developer becomes. Accordingly, by increasing the peak-to-peak value of the applied a.c. bias, the vibration of the developer is made large and the discharge of the developer from the developer discharge portion 22*h* is alleviated.

For example, in the example of the table 5, when the toner concentration is 8% and the absolute humidity is 10 g/m³, the peak-to-peak value of the a.c. bias is brought to 0 V (not applied); when the toner concentration is 10% and the absolute humidity is 5%, the peak-to-peak value of the a.c.

bias is brought to 1600 V; and when the toner concentration is 10% and the absolute humidity is 20 g/m$^3$, the peak-to-peak value of the a.c. bias is brought to 800 V. As a result of this, it is possible to confine the stable weight of the developer into a range of 211 g to 225 g close to the stable weight (216 g) in the reference condition, and confine the stable volume of the developer into a range of 117 cm$^3$ to 128 cm$^3$ close to the stable volume (122 cm$^3$) in the reference condition.

From the above results, in the developing device 3*a* of the present disclosure in which the electro-conductive plate 70 is disposed on the inner wall surface that opposes the regulating portion 52; and the electric potential difference is generated between the regulating portion 52 and the electro-conductive plate 70 by applying the a.c. bias to the second stirring screw 44, the change in the stable weight of the developer is alleviated at a time when the stirring speed of the developer, the toner concentration, and the absolute humidity are varied. Accordingly, it is possible to effectively alleviate the occurrence of a defective image and the deterioration in the developer, especially in the case where the stirring speed is varied, it is confirmed that the changes in the stable weight and stable volume of the developer are remarkably alleviated.

Besides, it is confirmed that by varying the peak-to-peak value of the a.c. bias applied to the second stirring screw 44, the stable weight of the developer is adjustable in accordance with the toner concentration and the absolute humidity.

The present disclosure is applicable to: a developing device that supplies a two-component developer containing toners and carriers and discharges a surplus developer; and an image forming apparatus that includes the developing device. By using the present disclosure, even in the case where the fluidity and conveyance speed of the developer change, it is possible to provide a developing device that is able to make a change range of the height and weight of the developer in the developer container small.

What is claimed is:

1. A developing device comprising:

a developer container which has a plurality of conveyance chambers including a first conveyance chamber and a second conveyance chamber disposed in parallel with each other, and communication portions that allow the first and second conveyance chambers to communicate with each other on both end portion sides in a longitudinal direction of the first and second conveyance chambers, the developer container being provided with a developer supply portion that supplies a developer into the developer container and a developer discharge portion which is disposed through an end portion on a downstream side of the second conveyance chamber and through which a surplus developer is discharged, the developer container storing a two-component developer that contains carriers and toners;

a first stirring member that is composed of a rotation shaft and a first spiral blade formed on an outer circumference of the rotation shaft, stirs and conveys the developer in the first conveyance chamber in a rotation shaft direction;

a second stirring member that is composed of a rotation shaft and a second spiral blade formed on an outer circumference of the rotation shaft, stirs and conveys the developer in the second conveyance chamber in a direction opposite to the first stirring member; and a developer carrying member that is supported rotatably by the developer container and bears, on a surface thereof, the developer in the second conveyance chamber; wherein the second stirring member is provided with an electro-conductive regulating portion that is disposed to oppose the developer discharge portion on a more downstream side than the communication portion in a conveyance direction of the developer in the second conveyance chamber, and regulates movement of the developer to the developer discharge portion;

an electro-conductive plate is disposed on an inner wall surface of the developer container that opposes the regulating portion;

during rotation and driving of the first stirring member and second stirring member, by applying an alternating current bias to at least one of the regulating portion and the electro-conductive plate to generate an electric potential difference between the regulating portion and the electro-conductive plate.

2. The developing device according to claim 1, wherein the regulating portion and the electro-conductive plate are each formed of a non-magnetic material.

3. The developing device according to claim 1, wherein based on at least one of a stirring speed of the developer in the second conveyance chamber, a toner concentration of the developer, and an absolute humidity, the electric potential difference between the regulating portion and the electro-conductive plate is varied.

4. The developing device according to claim 3, wherein as the stirring speed of the developer in the second conveyance chamber becomes larger, the electric potential difference between the regulating portion and the electro-conductive plate is made larger.

5. The developing device according to claim 3, wherein as the toner concentration becomes higher, the electric potential difference between the regulating portion and the electro-conductive plate is made larger.

6. The developing device according to claim 3, wherein as the absolute humidity becomes lower, the electric potential difference between the regulating portion and the electro-conductive plate is made larger.

7. The developing device according to claim 1, wherein the alternating current bias is applied to both the regulating portion and the electro-conductive plate, and the alternating current bias applied to the regulating portion and the alternating current bias applied to the electro-conductive plate are reversed from each other in phase.

8. An image forming apparatus which incorporates a developing device according to claim 1.

* * * * *